US007591965B2

(12) United States Patent
Makuta et al.

(10) Patent No.: US 7,591,965 B2
(45) Date of Patent: Sep. 22, 2009

(54) RESISTANCE PASTE AND RESISTOR

(75) Inventors: Fujio Makuta, Tokyo (JP); Toshiki Maeda, Ehime (JP)

(73) Assignee: Sumitomo Metal Mining Co., Ltd., Tokyo (JP)

( * ) Notice: Subject to any disclaimer, the term of this patent is extended or adjusted under 35 U.S.C. 154(b) by 0 days.

(21) Appl. No.: 11/376,095

(22) Filed: Mar. 16, 2006

(65) Prior Publication Data

US 2006/0208234 A1 Sep. 21, 2006

(30) Foreign Application Priority Data

Mar. 17, 2005 (JP) ..... 2005-076229
Mar. 17, 2005 (JP) ..... 2005-076230
Jan. 13, 2006 (JP) ..... 2006-005499

(51) Int. Cl.
*H01B 1/00* (2006.01)
*H01B 1/02* (2006.01)
*H01C 7/10* (2006.01)

(52) U.S. Cl. ..... 252/518.1; 338/22 R

(58) Field of Classification Search ..... 252/500, 252/518.1; 338/22 R
See application file for complete search history.

(56) References Cited

U.S. PATENT DOCUMENTS 3,304,199 A * 2/1967 Faber, Sr. et. al. ..... 428/426
4,051,074 A * 9/1977 Asada ..... 252/503
4,286,251 A * 8/1981 Howell ..... 338/309
4,698,265 A 10/1987 Kuo
5,378,408 A * 1/1995 Carroll et al. ..... 252/514
5,645,765 A * 7/1997 Asada et al. ..... 252/519.51
6,328,914 B1 * 12/2001 Lautzenhiser et al. ..... 252/510
6,480,093 B1 11/2002 Chen

FOREIGN PATENT DOCUMENTS

GB 1219761 1/1971
JP 54-1917 1/1979

OTHER PUBLICATIONS

K. Adachi et al., "Effect of Glass Composition on the Electrical Properties of Thick-Film Resistors" in Am. Ceramic Soc. 83(10)(2000), pp. 2441-2448.
English Abstract of JP 54079495.
English Abstract of JP 05113394.

* cited by examiner

*Primary Examiner*—Mark Kopec
*Assistant Examiner*—Jaison P Thomas
(74) *Attorney, Agent, or Firm*—Dykema Gossett PLLC

(57) ABSTRACT

A lead-free resistance paste and a lead-free resistor that is formed with the resistance paste and has a high resistance value and excellent electric characteristics are disclosed. The resistance paste is substantially made of electrically conductive particles, glass frit and an organic vehicle, wherein the electrically conductive particles are made of iridium dioxide ($IrO_2$) alone, or of iridium dioxide and ruthenium dioxide ($RuO_2$) which has an average particle diameter of 1.0 μm or less, and the glass frit is glass frit that has an average particle diameter of 5 μm or less and does not contain lead such as borosilicate glass.

6 Claims, No Drawings

RESISTANCE PASTE AND RESISTOR

BACKGROUND OF THE INVENTION

1. Field of the Invention

The present invention relates to a paste used for forming a resistor such as a thick film chip resistor and a hybrid IC, in particular, a resistance paste that does not contains lead, and a resistor formed from the resistance paste.

2. Description of Related Art

Hitherto, as a method of forming a resistor film of an electronic component, a thick film method that uses a resistance paste and a thin film method where a film-forming material is sputtered are well known. Of these, in the thick film method, a resistance paste is printed on a ceramic substrate, followed by sintering to form a thick film resistor. The method, being cheap in equipment and high in the productivity, is widely used in the manufacture of a chip resistor and a resistor of a hybrid IC or the like.

A resistance paste that is used in the thick film method is substantially constituted of electrically conductive particles, glass frit and an organic vehicle that makes these paste-like one suitable for printing. As the electrically conductive particles, ruthenium dioxide ($RuO_2$) and pyrochlore type ruthenium based oxide ($Pb_2Ru_2O_{7-x}$, $Bi_2Ru_2O_7$) are generally used. The reason why the Ru based oxide is used as the electrically conductive particle is mainly because a resistance value smoothly varies with a concentration of the electrically conductive particles.

Furthermore, the glass frit controls a resistance value at an arbitrary value depending on a ratio thereof to the electrically conductive particles and contributes as well to retention of the film strength of the resistor and to the adhesion with the substrate. As the glass frit, lead borosilicate based glass containing much lead such as lead borosilicate glass ($PbO—SiO_2—B_2O_3$) or lead aluminoborosilicate glass ($PbO—SiO_2—B_2O_3—Al_2O_3$) is used. The reason why the lead borosilicate based glass is used as the glass frit is in that the wettability with the Ru based oxide is excellent, the thermal expansion coefficient is close to that of the substrate and the viscosity at the sintering is preferable.

As other electrically conductive particle than the Ru based oxide, iridium dioxide ($IrO_2$) is known as well (JP-B-54-1917). However, the iridium dioxide as the electrically conductive particle has been as well used in a resistance paste that uses glass that contains lead such as the lead borosilicate based glass as the glass frit.

On the other hand, recently, from a viewpoint of environmental protection, lead-free electronic components are advanced. Accordingly, the resistance paste is as well strongly demanded to be free from lead. However, in a combination of electrically conductive particles of the Ru based oxide and the glass frit that does not contain lead, it is known that as a ratio of the electrically conductive particles becomes smaller, the resistance value rapidly goes up (*J. Am. Ceram. Soc.,* 83(10), (2000), p2441-2448). Accordingly, in a thick film resistor formed with the resistance paste, there are problems in that the dispersion of the resistance values at high resistance becomes larger and current noise as well becomes larger.

SUMMARY OF THE INVENTION

Accordingly, an object of the invention is to provide a resistance paste and a resistor, which do not contain lead, in particular, to provide a lead-free resistance paste that can form a thick film resistor that, while maintaining a high resistance value, is small in the dispersion of resistance values and current noise and has excellent electrical characteristics, and a lead-free resistor formed with the resistance paste.

The Inventors, after studying hard of a lead-free resistance paste, found that when at least iridium dioxide is used as the electrically conductive particle, even when the glass frit is glass frit that does not contain lead, a lead-free resistance paste having excellent electric characteristics can be obtained, and thereby came to completion of the invention.

That is, a first resistance paste that the invention provides is a resistance paste comprising electrically conductive particles, glass frit and an organic vehicle, wherein the electrically conductive particles are made of iridium dioxide and the glass frit is glass frit that does not contain lead.

In the first resistance paste according to the invention, it is preferable that an average particle diameter of the iridium dioxide is preferably 1.0 μm or less and an average particle diameter of the glass frit that does not contain lead is preferably 5 μm or less.

A second resistance paste that the invention provides is a resistance paste comprising electrically conductive particles, glass frit and an organic vehicle, the electrically conductive particles being made of iridium dioxide and ruthenium dioxide, a ratio of iridium dioxide in the electrically conductive particles being 25% by weight or more and less than 100% by weight, and the glass frit being glass frit that does not contain lead.

In the second resistance paste according to the invention, it is preferable that average particle diameters of the iridium dioxide and ruthenium dioxide are preferably 1.0 μm or less and an average particle diameter of the glass frit that does not contain lead is preferably 5 μm or less.

The invention further provides a resistor that is formed by firing any one of the first resistance paste and second resistance paste and does not contain lead.

A first resistor that the invention provides is a resistor containing electrically conductive particles in a mother phase made of glass, wherein the mother phase made of glass does not contain lead and the electrically conductive particles are made of iridium dioxide.

Furthermore, a second resistor that the invention provides is a resistor containing electrically conductive particles in a mother phase made of glass, wherein the mother phase made of glass does not contain lead, the electrically conductive particles are made of iridium dioxide and ruthenium dioxide, and a ratio of iridium dioxide in the electrically conductive particles is 25% by weight or more and less than 100% by weight.

According to the invention, since hazardous lead can be eliminated from a resistance paste and a resistor formed therewith, a problem of environmental contamination can be eliminated. Accordingly, when the resistance paste according to the invention is used, different from an existing resistance paste that contains lead, the environmental contamination is not caused, and a resistor that has a high resistance value and is small in the dispersion of resistance values and current noise and excellent in the electrical characteristics can be formed.

DETAILED DESCRIPTION OF THE INVENTION

In the resistance paste according to the invention, as the electrically conductive particle, iridium dioxide is used singularly (the first resistance paste) or iridium dioxide is used together with ruthenium dioxide (the second resistance paste). However, in the case of the second resistance paste where iridium dioxide and ruthenium dioxide are used together as the electrically conductive particle, a ratio of iridium dioxide in the electrically conductive particles is necessarily 25% by weight or more and less than 100% by weight. When the ratio of the iridium dioxide in the electrically conductive particles is less than 25% by weight, the current noise of the obtained thick film resistor becomes larger.

The iridium dioxide ($IrO_2$) that is used in the invention, without restricting to particular one, may be any of ones that are manufactured according to various kinds of manufacturing methods. For instance, a method where iridium hydroxide obtained by neutralizing an iridium chloride aqueous solution is calcined and a method where chloroiridate is calcined can be used to manufacture iridium dioxide. However, in order to inhibit the dispersion of the resistance values and the current noise from deteriorating, an electrically conductive path in the resistor is necessarily made finer. Accordingly, an average particle diameter of iridium dioxide is preferably 1.0 μm or less.

Furthermore, the ruthenium dioxide ($RuO_2$) as well, without restricting to particular one, may be any of ones that are manufactured according to various kinds of manufacturing methods. For instance, ruthenium dioxide can be manufactured in such a manner that metal ruthenium is alkali fused together with potassium nitrate and potassium hydroxide, an organic material or acid is added to obtained potassium ruthenate, and generated ruthenium oxide hydrate or ruthenium hydroxide is calcined. An average particle diameter of ruthenium dioxide as well, similarly to the case of iridium dioxide, in order to inhibit the dispersion of the resistance values and the current noise from deteriorating, is preferably 1.0 μm or less.

The glass frit used in the invention, as far as it does not contain lead, is not particularly restricted in a composition thereof. For instance, borosilicate glass, aluminoborosilicate glass, alkali earth borosilicate glass, alkali borosilicate glass, zinc borosilicate glass, bismuth borosilicate glass and so on can be preferably used. Furthermore, an average particle diameter of the glass frit is preferably 5 μm or less. When the average particle diameter of the glass frit exceeds 5 μm, a fine electrically conductive path can be formed with difficulty in the resistor, resulting in deteriorating the dispersion of the resistance values and the current noise.

Furthermore, as the organic vehicle, ones that have been so far ordinarily used in the resistance paste may be used. For instance, one in which a resin such as ethyl cellulose, butyral, acryl or the like is dissolved in a solvent such as terpineol, butyl carbitol acetate or the like can be preferably used.

In the resistance paste according to the invention, other than the above-mentioned indispensable components, various kinds of additives hitherto used to adjust the electric characteristics of the resistor, a dispersing agent, a plasticizer or the like can be appropriately added. Furthermore, in order to manufacture the resistance paste according to the invention, by use of a commercially available pulverizer such as a roll mill, the above-mentioned respective components may well be pulverized and blended.

By use of the resistance paste according to the invention, similarly to an existing method, a resistor can be formed. For instance, either one of the first resistance paste or the second resistance paste according to the invention is used to coat on an ordinary substrate such as an alumina substrate or the like by means of the screen printing method, after drying, followed by sintering at a peak temperature in the range of substantially 800 to 900° C. in a belt furnace, and thereby a lead-free resistor can be formed.

Thus obtained resistor according to the invention contains electrically conductive particles in a mother phase made of glass and the mother phase made of the glass does not contain lead. In the case of the first resistor, the electrically conductive particles are made of iridium dioxide, and in the case of the second resistor the electrically conductive particles are made of iridium dioxide and ruthenium dioxide and a ratio of iridium dioxide in the electrically conductive particles is 25% by weight or more and less than 100% by weight.

Accordingly, the resistance paste and the resistor according to the invention do not contain lead. As a result, different from existing resistance pastes and resistors that contain lead, environmental contamination is avoided. Furthermore, the resistor according to the invention has excellent electric characteristics same as that of the existing one and in particular can suppress the dispersion of the resistance values and the current noise low.

EXAMPLES

Example 1

In a chloroiridate aqueous solution, a potassium hydroxide aqueous solution was added to neutralize, generated iridium hydroxide is calcined, and thereby $IrO_2$ (A) powder having an average particle diameter of 23 nm was obtained. Next, 1.1 g of the $IrO_2$ (A) powder, 4.9 g of frit (average particle diameter: 1.9 μm made of glass (A) having a composition of 10% by weight SrO-43% by weight $SiO_2$-16% by weight $B_2O_3$-4% by weight $Al_2O_3$-20% by weight ZnO-7% by weight $Na_2O$ and 4.0 g of an organic vehicle mainly made of ethyl cellulose and terpineol were blended, followed by kneading with a three-roll mill, and thereby a resistance paste was prepared.

The resistance paste according to Example was screen printed in a size of 1 mm×1 mm on an alumina substrate, followed by drying at 150° C. for 10 mim further followed by sintering at a peak temperature of 850° C. for 9 mim in a belt furnace, and thereby a thick film resistor was obtained. The thick film resistor obtained according to Example 1 was measured for electric characteristics (resistance value, dispersion of the resistance values, current noise), and the results are shown in Table 1 below.

The resistance value was measured according to a four terminal method with Model 2001 Multimeter (manufactured by KEITHLEY Corp.) and the current noise was measured under application of 1/10 W with a Noisemeter Model 315C (manufactured by Quan-Tech Corp.). The sheet resistivity value is an average value of 10 points of resistors, and the dispersion of the resistance values is a value obtained by dividing a standard deviation of the resistance values with an average resistance value.

Example 2

Potassium hexachloroiridate (IV) that is a chloroiridate was calcined and thereby $IrO_2$ (B) powder having an average particle diameter of 79 nm was obtained. Next, 1.2 g of the $IrO_2$ (B) powder, 4.8 g of glass frit made of the glass (A) same as that of the Example 1 and 4.0 g of an organic vehicle were blended, followed by kneading with a three-roll mill, and thereby a resistance paste was prepared.

With the resistance paste according to Example 2, similarly to the Example 1, a thick film resistor was prepared. The thick film resistor obtained according to Example 2 was measured for electric characteristics similarly to the Example 1, and the obtained results are shown in Table 1 below.

Example 3

Ammonium hexachloroiridate (IV) that is a chloroiridate was calcined and thereby $IrO_2$ (C) powder having an average particle diameter of 45 nm was obtained. Next, 1.0 g of the $IrO_2$ (C) powder, 5.0 g of glass frit made of the glass (A) same as that of the Example 1 and 4.0 g of an organic vehicle were blended, followed by kneading with a three-roll mill, and thereby a resistance paste was prepared.

With the resistance paste according to Example 3, similarly to the Example 1, a thick film resistor was prepared. The thick film resistor obtained according to Example 3 was measured of the electric characteristics similarly to the Example 1, and obtained results are shown in Table 1 below.

Comparative Example 1

A half gram of $RuO_2$ powder (average particle diameter: 35 nm) obtained by calcining ruthenium hydroxide, 5.5 g of glass frit made of the glass (A) same as that of the Example 1 and 4.0 g of an organic vehicle were blended, followed by kneading with a three-roll mill, and thereby a resistance paste was prepared.

With the resistance paste according to the Comparative Example 1, similarly to the Example 1, a thick film resistor was prepared. The thick film resistor obtained according to Comparative Example 1 was measured for electric characteristics similarly to the Example 1, and the obtained results are shown in Table 1 below.

Comparative Example 2

In the next place, 1.0 g of the $RuO_2$ powder (average particle diameter: 35 nm) same as the Comparative Example 1, 5.5 g of glass frit made of glass (B) having a composition of 38% by weight PbO-35% by weight $SiO_2$-6% by weight $B_2O_3$-6% by weight $Al_2O_3$-10% by weight CaO-5% by weight ZnO and 3.5 g of an organic vehicle same as that of the Example 1 were blended, followed by kneading with a three-roll mill, and thereby a resistance paste was obtained.

With the resistance paste according to the Comparative Example 2, similarly to the Example 1, a thick film resistor was prepared. The thick film resistor obtained according to Comparative Example 2 was measured for electric characteristics similarly to the Example 1, and the obtained results are shown in Table 1 below.

TABLE 1

| | Electrically conductive particle | Glass frit | Sheet resistivity (kΩ/□) | Dispersion of resistance values (%) | Current Noise (dB) |
|---|---|---|---|---|---|
| Example 1 | $IrO_2$ (A) | Glass (A) | 98 | 4.5 | 0.1 |
| Example 2 | $IrO_2$ (B) | Glass (A) | 100 | 5.0 | 8.7 |
| Example 3 | $IrO_2$ (C) | Glass (A) | 91 | 2.7 | 0.3 |
| Comparative Example 1 | $RuO_2$ | Glass (A) | 93 | 11.4 | 15.4 |
| Comparative Example 2 | $RuO_2$ | Glass (B) | 99 | 3.9 | 2.3 |

As obvious from the results above, in the resistance pastes according to Examples 1 through 3 where the electrically conductive particles are singularly made of $IrO_2$, even when glass frit that does not contain lead is used, the dispersion of the resistance values of the thick film resistors and the current noise thereof can be made small and the electric characteristics same in level as that of Comparative Example 2 that is an existing example can be obtained. On the other hand, in Comparative Example 1 where the electrically conductive particles are made of $RuO_2$ and glass frit that does not contain lead is used, it is found that the dispersion of the resistance values of the thick film resistors and the current noise thereof abruptly increase.

Example 4

Iridium dioxide ($IrO_2$) was manufactured by calcining ammonium hexachloroiridate (IV). Furthermore, ruthenium dioxide ($RuO_2$) was manufactured by calcining ruthenium hydroxide. An average particle diameter of the $IrO_2$ powder was 45 nm and that of $RuO_2$ powder was 35 nm.

To 0.7 g of the $IrO_2$ powder and 0.1 g of $RuO_2$ powder, 5.1 g of glass frit made of glass (A) having a composition of 10% by weight SrO-43% by weight $SiO_2$-16% by weight $B_2O_3$-4% by weight $Al_2O_3$-20% by weight ZnO-7% by weight $Na_2O$ and 4.1 g of an organic vehicle mainly made of ethyl cellulose and terpineol were blended, followed by kneading with a three-roll mill, and thereby a resistance paste was prepared.

The resistance paste according to Example 4 was screen printed in a size of 1 mm×1 mm on an alumina substrate, followed by drying at 150° C. for 10 mm further followed by sintering at a peak temperature of 850° C. for 9 mm in a belt furnace. The thick film resistor obtained according to Example 4 was measured for electric characteristics (resistance value, dispersion of the resistance values, current noise) similarly to the Example 1, and the results are shown in Table 2 below.

Example 5

Except that 0.5 g of $IrO_2$ powder same as that used in the Example 4, 0.2 g of $RuO_2$ powder, 5.1 g of glass frit made of glass (A) and 4.2 g of an organic vehicle were used, similarly to the Example 4, a resistance paste was prepared.

With the resistance paste according to the Example 5, similarly to the Example 4, a thick film resistor was formed.

The thick film resistor obtained according to Example 5 was measured for electric characteristics similarly to the Example 1, and the obtained results are shown in Table 2 below.

Example 6

Except that 0.2 g and 0.3 g, respectively, of $IrO_2$ powder and $RuO_2$ powder that are same as that used in the Example 4, 5.1 g of glass frit made of glass (A) and 4.4 g of an organic vehicle were used, similarly to the Example 4, a resistance paste was prepared.

With the resistance paste according to the Example 6, similarly to the Example 4, a thick film resistor was formed. The thick film resistor obtained according to Example 6 was measured for electric characteristics similarly to the Example 1, and the obtained results are shown in Table 2 below.

TABLE 2

| | Electrically conductive particle (% by weight) | Glass frit | Sheet resistivity (kΩ/□) | Dispersion of resistance values (%) | Current Noise (dB) |
|---|---|---|---|---|---|
| Example 4 | 88% $IrO_2$ 12% $RuO_2$ | Glass (A) | 73 | 4.5 | 1.2 |
| Example 5 | 71% $IrO_2$ | Glass (A) | 76 | 3.0 | 2.5 |

TABLE 2-continued

| | Electrically conductive particle (% by weight) | Glass frit | Sheet resistivity (kΩ/□) | Dispersion of resistance values (%) | Current Noise (dB) |
|---|---|---|---|---|---|
| Example 6 | 29% $RuO_2$ 40% $IrO_2$ 60% $RuO_2$ | Glass (A) | 79 | 4.7 | 6.5 |
| Comparative Example 1 | 100% $RuO_2$ | Glass (A) | 93 | 11.4 | 15.4 |
| Comparative Example 2 | 100% $RuO_2$ | Glass (B) | 99 | 3.9 | 2.3 |

As obvious from the results above, in the resistance pastes according to Examples 4 through 6 where the electrically conductive particles are made of $IrO_2$ and $RuO_2$, even when glass frit that does not contain lead is used, the dispersion of the resistance values of the thick film resistors and the current noise thereof can be made small and the electric characteristics same in level as that of Comparative Example 2 that is an existing example can be obtained. On the other hand, in Comparative Example 1 where the electrically conductive particles are made only of $RuO_2$ and do not contain $IrO_2$ and glass frit that does not contain lead is used, it is found that the dispersion of the resistance values of the thick film resistors and the current noise thereof abruptly increase.

What is claimed is:

1. A resistance paste comprising electrically conductive particles, glass frit and an organic vehicle, wherein the electrically conductive particles comprise iridium dioxide and ruthenium dioxide and the glass frit has an average particle diameter of 5 μm or less and does not contain lead, wherein the iridium dioxide has an average particle diameter of 23-79 nm, and wherein the ratio of iridium dioxide in the electrically conductive particles is 25% or more and 88% or less by weight of the total conductive particles.

2. The resistance paste according to claim 1, wherein the iridium dioxide has an-average particle diameter of 23-45 nm.

3. The resistance paste according to claim 1, wherein the iridium dioxide has an average particle diameter of 45 to 79 nm.

4. A resistor which displays a high resistance and low dispersion of resistance and low current noise, comprising electrically conductive particles in a mother phase made of glass frit, wherein the mother phase made of glass frit does not contain lead and has an average particle diameter of 5 μm or less, and the electrically conductive particles comprise iridium dioxide and ruthenium dioxide, wherein the iridium dioxide has an average particle diameter of 23-79 nm, and wherein the ratio of iridium dioxide in the electrically conductive particles is 25% or more and 88% or less by weight of the total conductive particles.

5. The resistor according to claim 4, wherein the iridium dioxide has an average particle diameter of 23-45 nm.

6. The resistor according to claim 4, wherein the iridium dioxide has a average particle diameter of 45 to 79 nm.

* * * * *